United States Patent [19]

Neace, Jr.

[11] Patent Number: 5,071,006

[45] Date of Patent: Dec. 10, 1991

[54] CONTAINER SUPPORT CARTRIDGE

[76] Inventor: Everett L. Neace, Jr., 320 Wilshire Blvd., Savannah, Ga. 31419

[21] Appl. No.: 608,846

[22] Filed: Nov. 5, 1990

[51] Int. Cl.[5] ..... B65D 71/00

[52] U.S. Cl. ..... 206/427; 229/239

[58] Field of Search ..... 206/139, 162, 200, 427, 206/428–435, 604, 605, 620, 626, 628, 616; 229/40

[56] References Cited

U.S. PATENT DOCUMENTS

| | | | |
|---|---|---|---|
| 2,718,301 | 9/1955 | Palmer | 206/427 |
| 3,002,613 | 10/1961 | Merkel et al. | 206/430 |
| 4,290,525 | 9/1981 | Sisson | 206/427 |
| 4,396,143 | 8/1983 | Killy | 206/427 |
| 4,417,647 | 11/1983 | Thibodeau | 206/427 |
| 4,706,805 | 11/1987 | Becher | 206/427 |
| 4,721,237 | 1/1988 | Leslie | 206/428 |
| 4,735,313 | 4/1988 | Schoenberg | 206/427 |
| 4,789,062 | 12/1988 | Walsh | 206/427 |
| 4,889,245 | 12/1989 | Rinke | 206/427 |

*Primary Examiner*—Jimmy G. Foster
*Attorney, Agent, or Firm*—Leon Gilden

[57] ABSTRACT

An elongate cartridge housing wherein a stacked array of beverage containers are arranged. The cartridge is provided for use as a magazine in replenishment of soft drink machines or the like, or alternatively for use in a stacked array to provide feeding of the cans as required subsequent to their transport. A rip cord is provided through a bottom end wall of the cartridge for permitting dispensing of the containers therefrom.

3 Claims, 4 Drawing Sheets

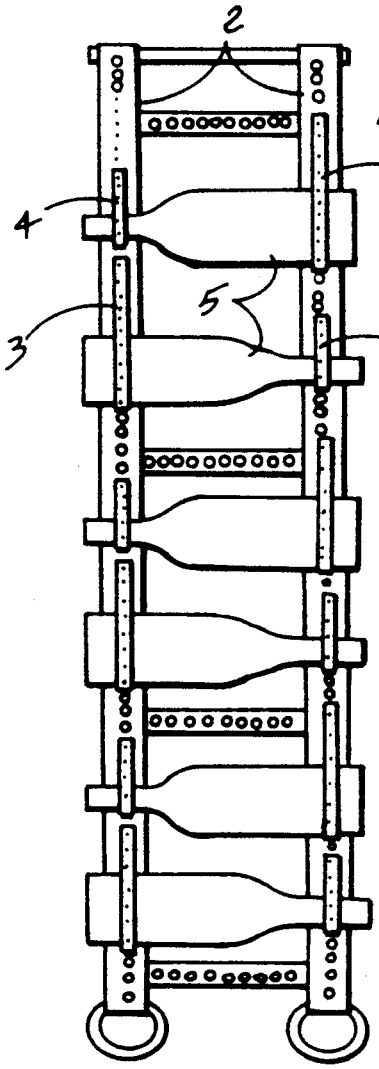
Fig 1
PRIOR ART
Fig 2
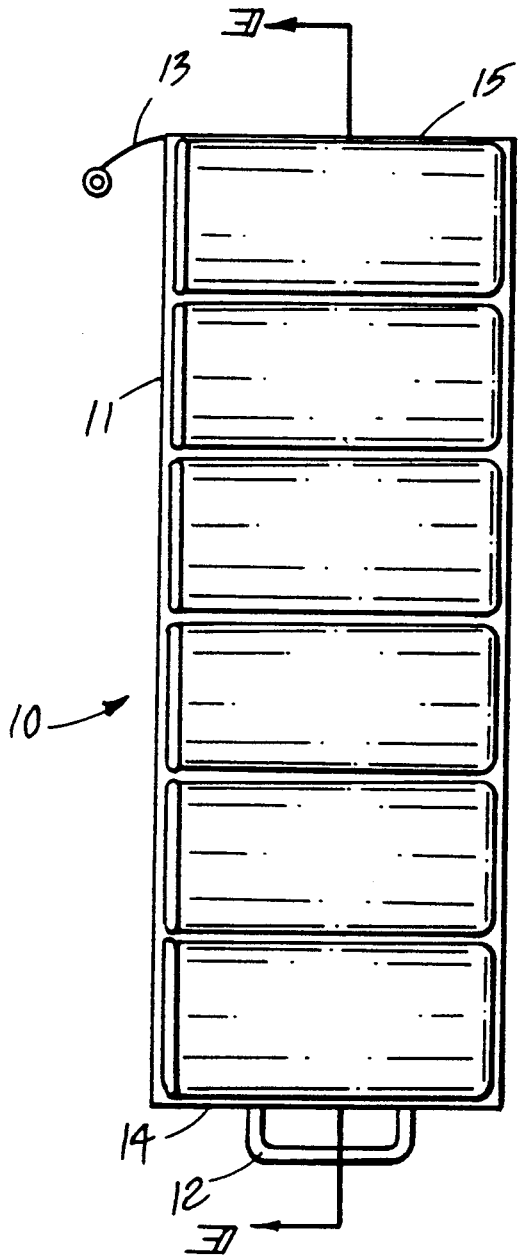

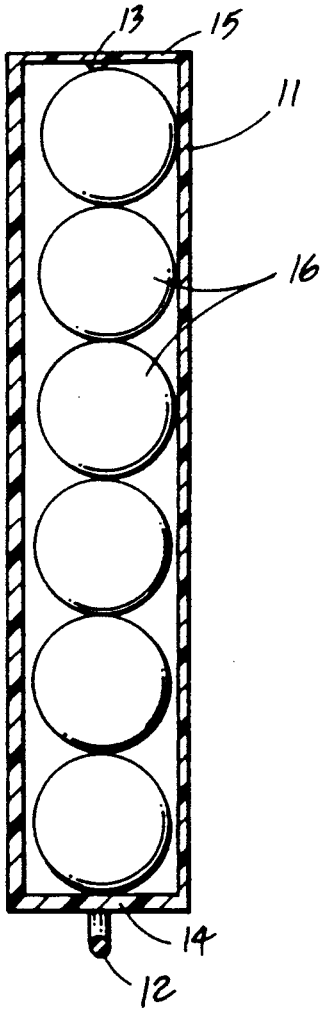
Fig 3
Fig 4
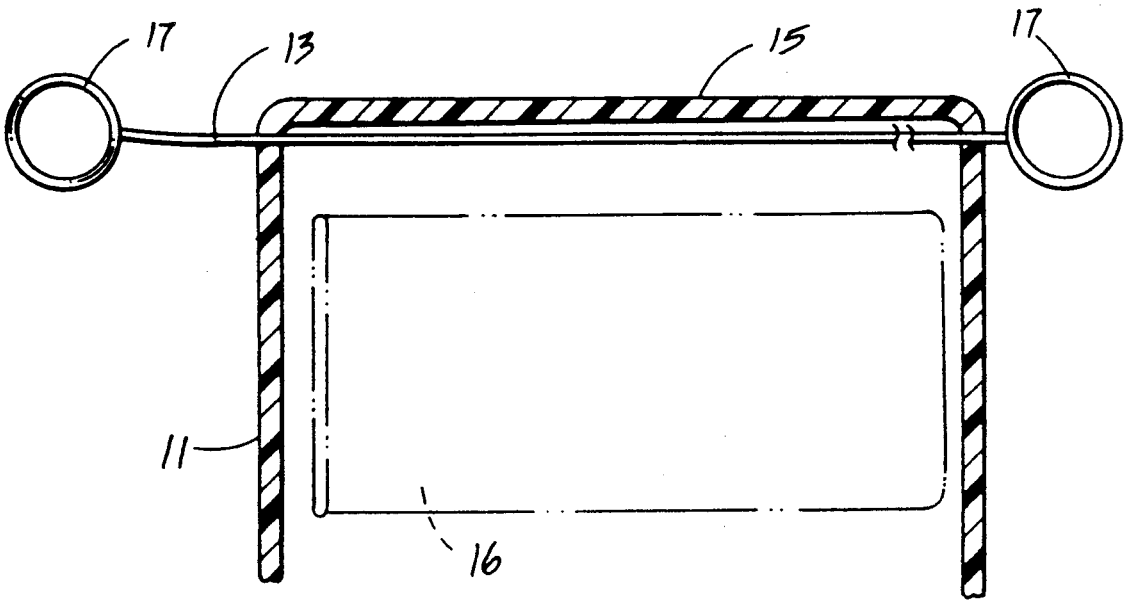

CONTAINER SUPPORT CARTRIDGE

BACKGROUND OF THE INVENTION

1. Field of the Invention

The field of invention relates to beverage containers, and more particularly pertains to a new and improved container support cartridge wherein the same permits ease of dispensing of containers from the cartridge.

2. Description of the Prior Art

The Prior art has provided packages of various types to secure containers therewithin. Such examples of the prior art may be found in U.S. Pat. No. 3,746,179 to Paumgardhen wherein a wine rack is provided with plural straps, wherein each strap includes alternating bands for mounting wine bottles in a parallel relationship.

U.S. Pat. No. 4,718,555 to Amberg sets forth a carrying tray with pockets therewithin for supporting containers and the like.

U.S. Pat. No. 4,577,765 to Crosby provides a wine rack wherein wine bottles are mounted in a horizontal orientation within chain-like supports disposed throughout the wine rack.

U.S. Pat. No. 4,671,405 to Hagan sets forth a shipping container for mounting glass bottles therewithin utilizing separated cylindrical sleeves for securing the bottles therewithin.

U.S. Pat. No. 4,854,465 to Reilly, et al. provides for a container, including recesses for securing various bottles and the like therewithin.

As such, it may be appreciated that there continues to be a need for a new and improved container support cartridge as set forth by the instant invention which addresses both the problems of ease of use as well as effectiveness in construction in providing convenience of dispensing of containers through a bottom wall of the cartridge.

SUMMARY OF THE INVENTION

In view of the foregoing disadvantages inherent in the known types of container package construction now present in the prior art, the present invention provides a container support cartridge wherein the same provides for the mounting and convenient dispensing through a bottom end wall of containers in a one-at-a-time relationship. As such, the general purpose of the present invention, which will be described subsequently in greater detail, is to provide a new and improved container support cartridge which has all the advantages of the prior art container support assemblies and none of the disadvantages.

To attain this, the present invention provides an elongate cartridge housing wherein a stacked array of beverage containers are arranged. The cartridge is provided for use as a magazine in replenishment of soft drink machines or the like, or alternatively for use in a stacked array to provide feeding of the cans as required subsequent to their transport. A rip cord is provided through a bottom end wall of the cartridge for permitting dispensing of the containers therefrom.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container support cartridge which has all the advantages of the prior art container support assemblies and none of the disadvantages.

It is another object of the present invention to provide a new and improved container support cartridge which may be easily and efficiently manufactured and marketed.

It is a further object of the present invention to provide a new and improved container support cartridge which is of a durable and reliable construction.

An even further object of the present invention is to provide a new and improved container support cartridge which is susceptible of a low cost of manufacture with regard to both materials and labor, and which accordingly is then susceptible of low prices of sale to the consuming public, thereby making such container support cartridges economically available to the buying public.

Still yet another object of the present invention is to provide a new and improved container support cartridge which provides in the apparatuses and methods of the prior art some of the advantages thereof, while simultaneously overcoming some of the disadvantages normally associated therewith.

Still another object of the present invention is to provide a new and improved container support cartridge wherein the same utilizes a transportable cartridge arranged for convenience of dispensing containers therefrom in a one-at-a-time relationship.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic frontal view, taken in elevation, of a prior art container support organization.

FIG. 2 is an orthographic frontal view, taken in elevation, of the instant invention.

FIG. 3 is an orthographic view, taken along the lines 3—3 of FIG. 2 in the direction indicated by the arrows.

FIG. 4 is an orthographic cross-sectional illustration of the rip cord and its associated with the package bottom end.

DESCRIPTION OF THE PREFERRED EMBODIMENT

Figure 5:
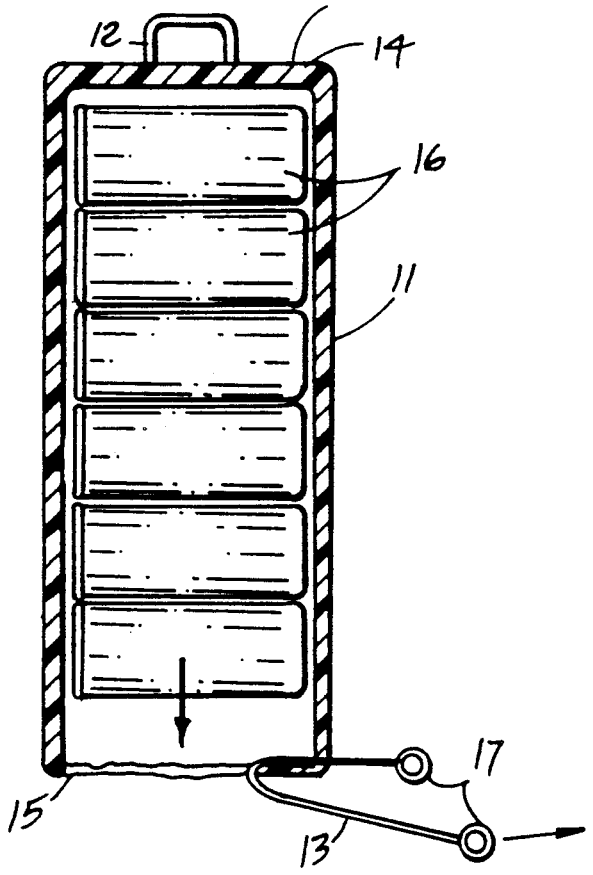
FIG. 5 is an orthographic cross-sectional illustration illustrating the rip cord in use to provide access to interior containers within the invention.

With reference now to the drawings, and in particular to FIGS. 1 to 8 thereof, a new and improved container support cartridge embodying the principles and concepts of the present invention and generally designated by the reference numeral 10 will be described.

FIG. 1 illustrates a prior art container support arrangement 1, wherein a series of wine bottles 5 are arranged in a horizontal orientation relative to one another mounted orthogonally between spaced parallel straps 2 that include alternating first and second strap loops 3 and 4 arranged in an alternating relationship on each strap 2 for securing the bottles 5, in a manner as set forth in U.S. Pat. No. 3,746,179.

More specifically, the container support cartridge 10 of the instant invention essentially comprises a polymeric housing member 11 of a generally rigid construction, including a handle 12 mounted to the package top end 14, with a rip cord 13 mounted interiorly of the package bottom end 15 and extending through the side walls of the package, with the rip cord 13 terminating in end ring member 17 to enhance manual grasping of the rip cord in severing the bottom end 15 to permit dispensing of the containers 16 for interiorly of the package. The containers 16 are stacked in a vertical array where it may be understood that the package of a width substantially equal to the diameter defined by each of the container, wherein alternatively the package may be formed of a width greater than the predetermined diameter of each container but less than twice the diameter to permit fastening of a permanent column of such containers, if required.

Figure 6:
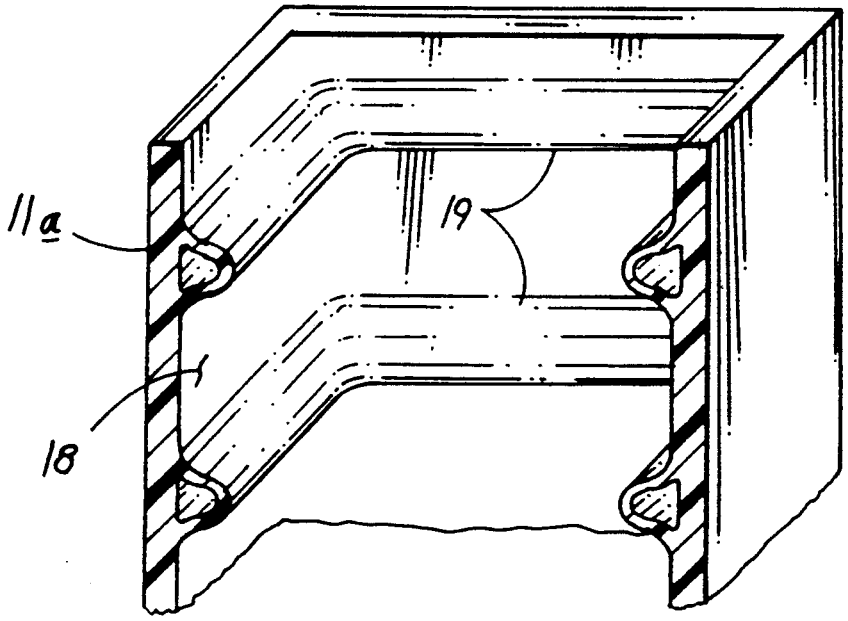
FIG. 6 is an orthographic cross-sectional illustration of a modified housing member utilized by the instant invention.

FIG. 6 illustrates a modified housing member 11*a*, wherein an interior wall surface 18 of the housing member 11*a* includes a series of equally spaced parallel and deformable pneumatically filled ridges 19 to retard depositing and dispensing of the containers through the severed opening once the rip cord 13 opens the package bottom end 15. In this manner, the containers are prevented from being unduly agitated during their deposit through the bottom end 15.

Figure 7:
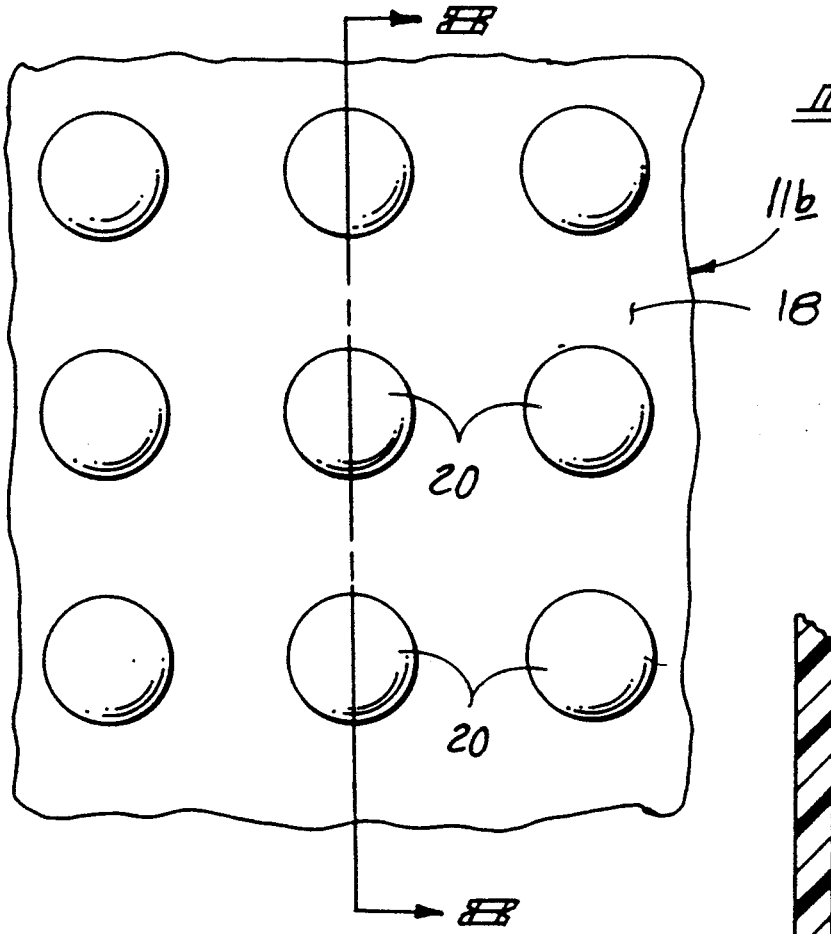
FIG. 7 is an orthographic frontal view, taken in elevation, of an interior surface of a further modified housing member utilized by the instant invention.
Figure 8:
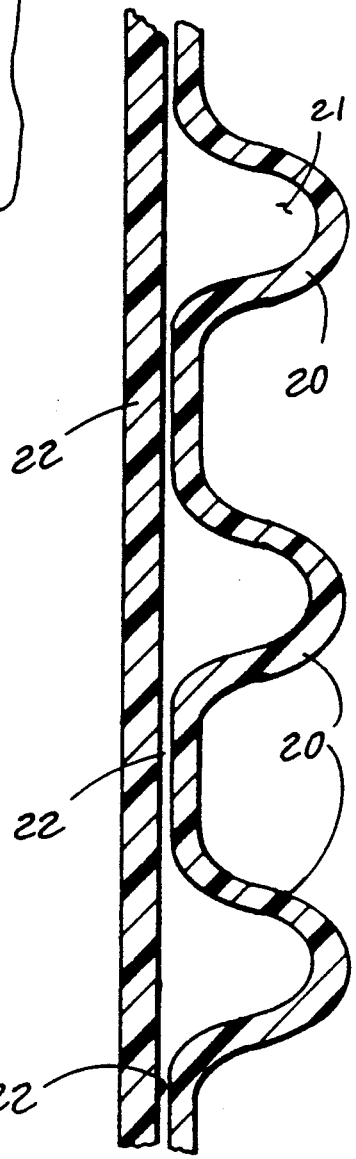
FIG. 8 is an orthographic view, taken along the lines 8—8 of FIG. 7 in the direction indicated by the arrows.

FIGS. 7 and 8 illustrate a further modified housing 11*b*, wherein the interior wall surface 18 includes a matrix of intercommunicating pneumatic projections 20, each defining a generally conical pocket 21 filled with pressurized air and each pocket intercommunicating by intercommunicating channels 22, with an intercommunicating channel 22 directed between adjacent pockets to permit the pockets to deform upon application of pressure thereto by cans being released from the housing member 11*b* to control the rate of release and permit the projections 20 to slowly deform in the descent of the containers 16 from interiorly of the housing member 11*b* through the opening defined through the package bottom end 15 upon the bottom end 15 being opened by the rip cord 13, in a manner as illustrated in FIG. 5.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An elongate longitudinally aligned container support cartridge, the support cartridge including a polymeric housing member of a generally parallelepiped configuration, with a top end spaced from a bottom end, the top end including a handle mounted thereto, and the bottom end including opening means mounted to the bottom end for selective opening of the bottom end for dispensing of containers stacked within the housing member, and the opening means includes a flexible rip cord mounted overlying an interior surface of the bottom end within the housing container, and wherein each terminal end of the rip cord extends through and exteriorly of spaced parallel side wall of the housing member, and each terminal end of the rip cord includes a ring member mounted thereon for permitting manual grasping of the rip cord in selective opening of the bottom end upon manual pulling of the rip cord.

2. A cartridge as set forth in claim 1 wherein the housing member includes an interior wall surface, with the interior wall surface including a plurality of equally spaced parallel pneumatic ridges mounted within the interior wall surface, wherein each of the ridges are continuous within the interior wall surface for positioning a container within each of the ridges and for retarding a rate of descent of each container.

3. A cartridge as set forth in claim 1 wherein the housing member includes an interior wall surface, and the interior wall surface includes a matrix of spaced parallel rows and columns intercommunicating pneumatically filled projections, the projections each including a generally conical pocket therewithin, and each of the pockets include an intercommunicating channel, wherein each channel is in pneumatic communication between adjacent pockets of the matrix of projections.

* * * * *